United States Patent [19]

Zebell

[11] 4,343,046

[45] Aug. 10, 1982

[54] PLURAL-SIZE ARTICLE OF WEARING APPAREL

[75] Inventor: Diane Zebell, St. Louis, Mo.

[73] Assignee: Angelica Corporation, St. Louis, Mo.

[21] Appl. No.: 164,538

[22] Filed: Jul. 2, 1980

[51] Int. Cl.[3] ..... A41D 1/22

[52] U.S. Cl. ..... 2/105; 2/74; 2/106

[58] Field of Search ..... 2/DIG. 7, 114, 75, 74, 2/106, 107, 118, 105

[56] References Cited

U.S. PATENT DOCUMENTS

| | | | |
|---|---|---|---|
| 339,407 | 4/1886 | Halsted | 2/105 |
| 1,118,913 | 11/1914 | Wells et al. | 2/74 |
| 1,251,996 | 1/1918 | Fuerst | 2/93 |
| 1,331,754 | 2/1920 | Gellenbeck | 2/105 |
| 1,488,635 | 1/1924 | Flannery | 2/105 |
| 1,906,912 | 5/1933 | Lockwood | 2/106 |
| 2,554,361 | 5/1951 | Ettien et al. | 2/105 |
| 2,661,475 | 12/1953 | Auslender | 2/105 |

*Primary Examiner*—Doris L. Troutman

*Attorney, Agent, or Firm*—Rogers, Eilers & Howell

[57] ABSTRACT

An article of wearing apparel has a panel of readily-expansible material in the front upper half thereof to enable that article of wearing apparel to be worn by persons of different sizes and configurations; and it has a panel of less-expansible material overlying and concealing the panel of readily-expansible material. The panel of less-expansible material permits free expansion and contraction of the panel of readily-expansible material while effectively concealing the latter panel.

11 Claims, 8 Drawing Figures

FIG. 1.
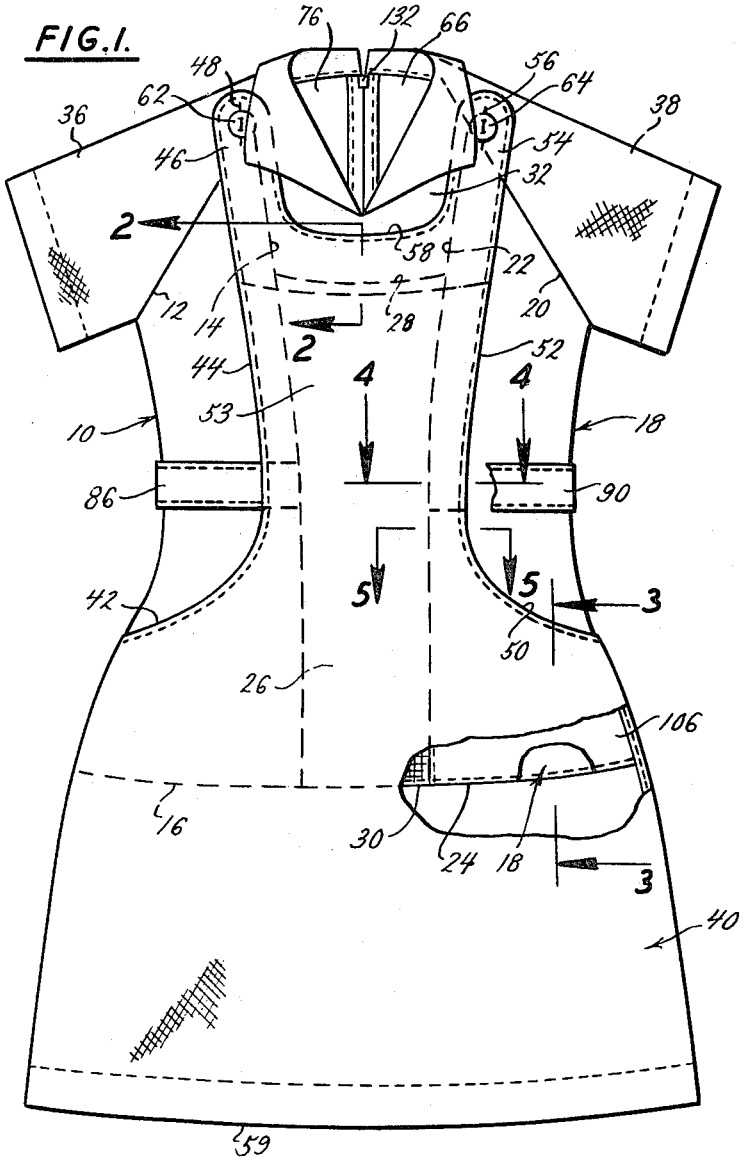
FIG. 2.
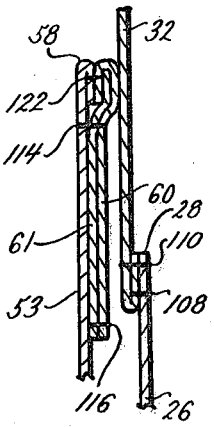
FIG. 3.
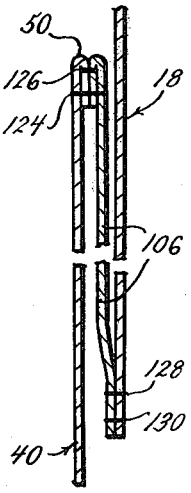
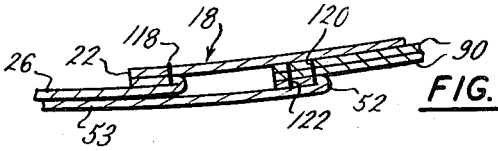
FIG. 4.
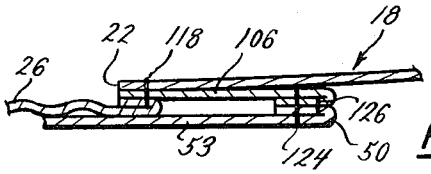
FIG. 5.

PLURAL-SIZE ARTICLE OF WEARING APPAREL

BACKGROUND OF THE INVENTION

Many articles of wearing apparel are sized to fit persons of closely-similar weights and configurations. As a result, a number of such articles are needed to make certain that light-weight and thinly-built persons, that heavy and sturdily-built persons, and that persons of intermediate weights and builds can be fitted properly. The resulting need of large inventories of such articles of wearing apparel makes the costs of fabricating and storing such articles of wearing apparel undesirably high.

SUMMARY OF THE INVENTION

An article of wearing apparel has a panel of readily-expansible material in the upper front half thereof to enable that article of wearing apparel to be worn by persons of different sizes and configurations; and it has a panel of less-expansible material overlying and concealing the panel of readily-expansible material. The panel of less-expansible material permits free expansion and contraction of the panel of readily-expansible material while effectively concealing the latter panel. The panel of readily-expansible material enables the article of wearing apparel to fit persons ranging from light, thinly-built persons to heavy, stoutly-built persons; and the panel of less-expansible material enables that article of wearing apparel to have an attractive essentially un-stressed appearance. It is, therefore, an object of the present invention to provide an article of wearing apparel which has a panel of readily-expansible material in the front upper half thereof and which has a panel of less-expansible material overlying and effectively concealing, but permitting free expansion and contraction of, the readily-expansible panel.

The article of wearing apparel has belt-like portions at the waist thereof which cooperate with fasteners to permit the waist of that article of wearing apparel to be adjusted to fit persons having waist sizes that range from small to large. The belt-like portions are connected to, and extend outwardly and rearwardly from, the panel of less-expansible material; and they are free to move relative to essentially all other portions of that article of wearing apparel. As a result, those belt-like portions can permit portions of the front, the sides, and the rear of that article of wearing apparel to "fall" in natural folds, of not-unattractive appearance, whenever those belt-like portions and the fasteners therefor are used to provide a small waist for that article of wearing apparel. Also, the front, the sides, and the rear of that article of wearing apparel can be filled out in an attractive manner when the belt-like portions and the fasteners therefor are used to provide a large waist for that article of wearing apparel. It is, therefore, an object of the present invention to provide an article of wearing apparel which has a panel of only limited expansibility and which has belt-like portions that are connected to, and that extend outwardly and rearwardly from, that panel and that are free to move relative to essentially all other portions of that article of wearing apparel.

Other and further objects and advantages of the present invention should become apparent from an examination of the drawing and accompanying description.

In the drawing and accompanying description a preferred embodiment of the present invention is shown and described, but it is to be understood that the drawing and accompanying description are for the purpose of illustration only and do not limit the invention and that the invention will be defined by the appended claims.

BRIEF DESCRIPTION OF THE DRAWING

In the drawing,

FIG. 1 is a partially broken-away, front elevational view of a uniform which is made in accordance with the principles and teachings of the present invention, FIG. 2 is a sectional view, on a larger scale, which is taken along the plane indicated by the line 2—2 in FIG. 1, FIG. 3 is another sectional view, on the scale of FIG. 2, and it is taken along the plane indicated by the line 3—3 in FIG. 1, FIG. 4 is a further sectional view, on the scale of FIG. 2, and it is taken along the plane indicated by the line 4—4 in FIG. 1, FIG. 5 is yet another sectional view, on the scale of FIG. 2, and it is taken along the plane indicated by the line 5—5 in FIG. 1.

DESCRIPTION OF PREFERRED EMBODIMENT

Figures 6, 7, 8:
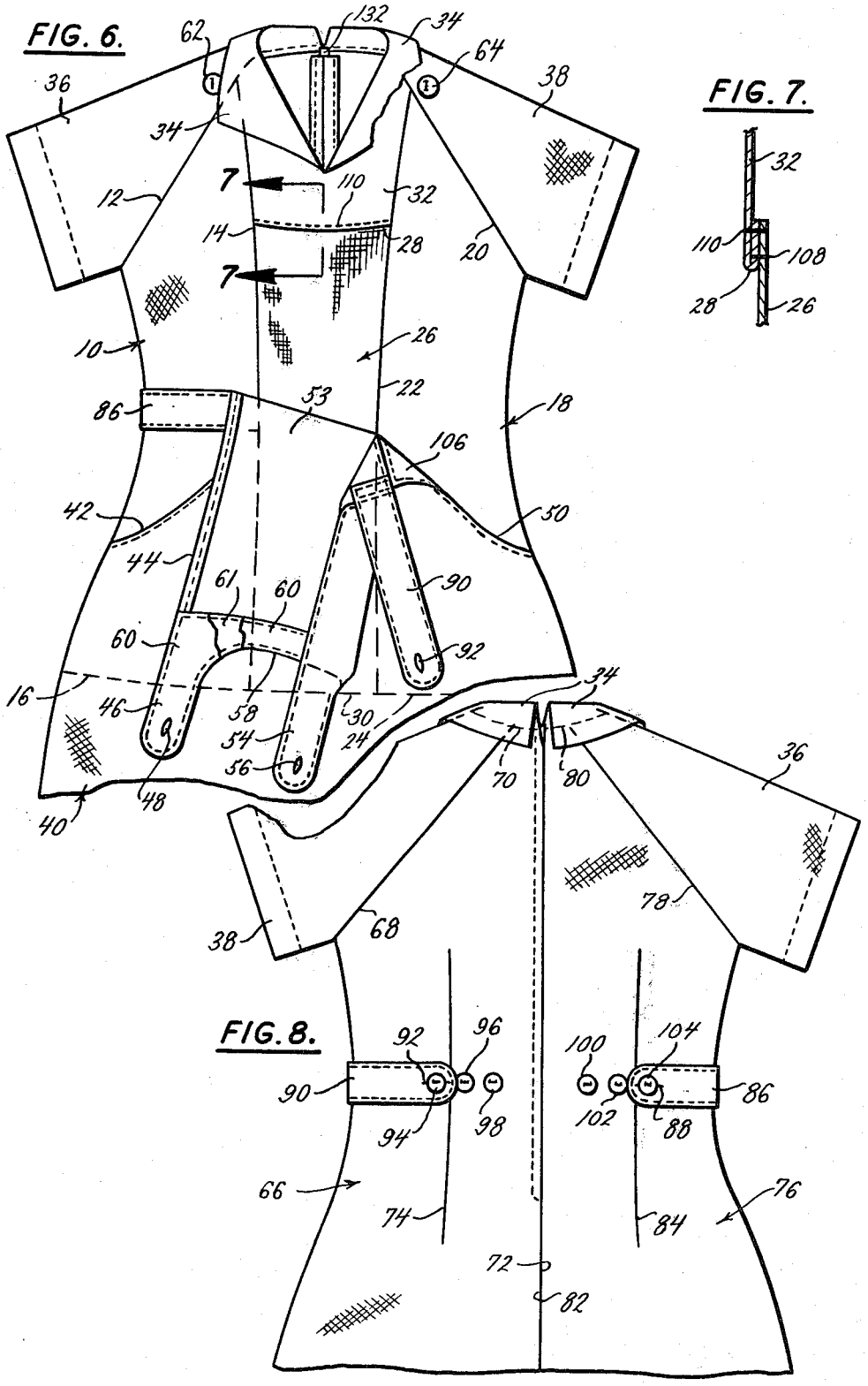
FIG. 6 is a front elevational view of the upper front part of the uniform of FIG. 1, as that uniform appears when a panel of less-expansible material is moved outwardly and downwardly to expose part of a panel of readily-expansible material, and it shows a part of that panel of less-expansible material folded back upon itself, and also shows the inner surface of one of the belt-like portions.
FIG. 7 is a sectional view, on the scale of FIG. 2, and it is taken along the plane indicated by the line 7—7 in FIG. 6.
FIG. 8 is a partially broken-away rear elevational view of the uniform of FIG. 1.

The numeral 10 generally denotes a vertically-directed panel which constitutes approximately one-third of the front upper half of the uniform shown by the drawing; and that panel has an upwardly and inwardly inclined upper edge 12, a generally-vertical left-hand edge 14, a generally-vertical right-hand edge, and a generally-horizontal lower edge 16. As used herein, the phrases "right-hand" and "left-hand" are related to the uniform when worn by the wearer and not as viewed in the drawing. The numeral 18 generally denotes a vertically-directed panel which is a mirror image of the panel 10, and which constitutes another one-third of the front upper half of the uniform. The upper edge 20 of panel 18 inclines upwardly and inwardly, the right-hand edge 22 is generally vertical, the left-hand edge also is generally vertical, and the lower edge 24 is generally horizontal. The numeral 26 generally denotes a vertically-directed panel which essentially constitutes the remaining one-third of the front upper half of the uniform provided by the present invention. The upper edge of panel 26 is denoted by the numeral 28, it is generally horizontal, and it is spaced well below the upper ends of the upper edges 12 and 20, respectively, of the panels 10 and 18. The left-hand edge of the panel 26 is secured to the right-hand edge 22 of panel 18. The right-hand edge of the panel 26 is secured to the left-hand edge 14 of the panel 10. The lower edge of the panel 26 is denoted by the numeral 30, it is generally horizontal, and it coacts with the lower edges 16 and 24, respectively, of the panels 10 and 18 to define an essentially continuous, generally-horizontal line.

The numeral 32 denotes a yoke which has the bottom of its front portion secured to the upper edge of the panel 26. The major portion of the right-hand side of the yoke 32 is secured to the upper portion of the left-hand edge 14 of the panel 10. Similarly, the major portion of the left-hand side of the yoke 32 is secured to the upper portion of the right-hand edge 22 of the panel 18.

The numeral 36 denotes the right-hand sleeve for the uniform; and the left-hand edge of the front portion of that sleeve is secured to the inclined upper edge 12 of panel 10 and also to the upper portion of the right-hand edge of yoke 32. The numeral 38 denotes the left-hand sleeve for the uniform; and that sleeve is a mirror image of the sleeve 36. The right-hand edge of the front portion of the sleeve 38 is secured to the upper edge 20 of panel 18 and also to the upper portion of the left-hand edge of yoke 32. The sleeves 36 and 38 are of standard and usual construction; and they are not, per se, parts of the present invention. Although those sleeves are shown as short sleeves, they could be made of any desired length. Also, those sleeves could be made in any desired configuration or style.

The numeral 40 generally denotes a vertically-directed panel which has a concave offset 42 at the right-hand side thereof a short distance below the waistline of the uniform, has a generally vertically-directed upper right-hand edge 44, has a right-hand strap-like portion 46 extending upwardly beyond the upper edge of the right-hand edge 44, has a buttonhole 48 adjacent the upper end of that strap-like portion, has a concave offset 50 at the left-hand side thereof which is a mirror image of the concave offset 42, has a generally vertically-directed upper left-hand edge 52, has a left-hand strap-like portion 54 extending upwardly above the upper edge of the edge 52, and has a buttonhole 56 adjacent the upper end of that strap-like portion. The generally vertically-directed upper edges 44 and 52 coact to help define a bib-like portion 53 for the panel 40. The strap-like portions 46 and 54 coact to define a generally U-shaped notch 58 at the upper edge of the bib-like portion 53. The lower edge 59 of the panel 40 constitutes the bottom edge of the front portion of the uniform. As indicated by FIG. 1, that lower edge 59 is spaced a substantial distance below the edges 16, 30 and 24, respectively, of the panels 10, 26 and 18. The numeral 60 constitutes a U-shaped reinforcement which is provided for the strap-like portions 46 and 54 and which also is provided for the upper section of the bib-like portion 53. As shown particularly by FIG. 2, a facing 61 is interposed between the upper section of bib-like portion 53 and the horizontally-directed portion of the U-shaped reinforcement 60.

The numeral 62 denotes a button which is secured to the forward portion of the sleeve 36 at a point which is close to the junction of yoke 32, the forward portion of that sleeve, and the upper portion of the edge 12 of panel 10. A similar button 64 is secured to the forward portion of the sleeve 38 at a point which is close to the junction of yoke 32, the forward portion of that sleeve, and the upper portion of the edge 20 of panel 18. The button 62 is dimensioned so the buttonhole 48 can be slipped over, but can be held by, that button. The button 64 is dimensioned so the buttonhole 56 can be slipped over, but can be held by, that button.

The numeral 66 denotes an elongated, vertically-directed panel which constitutes the left-hand half of the rear portion of the uniform. The upper left-hand edge of that panel is denoted by the numeral 68; and the narrow top edge of that panel is denoted by the numeral 70. A collar 34 is stitched to the narrow top edge 70 of panel 66, to the upper edge of the sleeve 38, to the upper edge of the yoke 32, to the upper edge of the sleeve 36, and to the narrow top edge 80 of an elongated vertically-directed panel 76 which is a mirror image of the panel 66. The panel 76 constitutes the right-hand half of the rear portion of the uniform.

The upper left-hand edge 68 of panel 66 is stitched to the rear portion of sleeve 38, the middle left-hand edge of that panel is stitched to the left-hand edge of panel 18 throughout the length of the latter panel and also to part of panel 40, and the lower left-hand edge of panel 66 is stitched to the rest of that portion of the left-hand edge of panel 40 which is located below the level of the concave offset 50. Those edges can be stitched together in any one of the standard and usual ways in which edges are stitched together to form neat and sturdy concealed seams. The resulting stitching will "close" the left-hand side of the uniform. The right-hand edge 72 of the panel 66 has the upper portion thereof stitched, in a standard and usual manner, to a tape at one side of a zipper 132; and it has the lower portion thereof stitched, in a standard and usual manner, to the left-hand edge 82 of the panel 76. A vertically-directed dart 74 is provided in the panel 66 to accommodate, at least in part, the usual difference between waist and hip measurements of wearers. The upper right-hand edge 78 of the panel 76 is stitched, in a standard and usual manner, to the rear portion of the sleeve 36. The middle right-hand edge of that panel is stitched, in a standard and usual manner, to the right-hand edge of panel 10 throughout the length of the latter panel and also to part of panel 40; and the lower right-hand edge of the former panel is stitched, in a standard and usual manner, to the rest of that portion of the right-hand edge of panel 40 which is below the level of the concave offset 42. That stitching "closes" the right-hand side of the uniform. A vertically-directed dart 84 is provided in the panel 76 to accommodate, at least in part, the usual difference between waist and hip measurements of wearers.

The numeral 86 denotes a belt-like portion which is attached to, and which extends outwardly to the right from, the right-hand edge 44 of the bib-like portion 53 of panel 40. The free end of that belt-like portion has a buttonhole 88 therein, as shown by FIG. 8. The numeral 90 denotes a belt-like portion which is a mirror image of the belt-like portion 86; and the former belt-like portion is secured to, and extends outwardly to the left from, the left-hand edge 52 of the bib-like portion 53 of the panel 40. A buttonhole 92 is provided adjacent the free end of the belt-like portion 90, as shown by FIGS. 6 and 8. The belt-like portions 86 and 90 are located close to the waist of the wearer of the uniform; and they are not connected to panel 10, to panel 26 or to panel 18. As a result, those panels are free to move relative to those belt-like portions. Buttons 94, 96 and 98 are secuted to panel 66 to form a generally-horizontal row; and buttons 100, 102 and 104 are secured to panel 76 to form a generally-horizontal row. As shown by FIG. 8, the generally-horizontal rows of buttons are aligned and are spaced short distances from the zipper 132.

The numeral 106 denotes a pocket lining which is shown in FIGS. 1, 3, 5 and 6. The upper edge of that pocket lining and the upper edge of the concave offset 50 are stitched together, in a standard and usual manner, by a row of stitches 126; and then those edges are folded in the manner shown by FIG. 3. A further row of stitching 124, of standard and usual design, is then provided to hold those edges in folded form. The bottom edge of the pocket lining 106 is secured to the lower edge of the panel 18 by rows of stitching 128 and 130, of standard and usual design. The outer edge of that pocket lining is secured to the right-hand edge of the panel 40, and also to the right-hand edge of the panel 76, by the stitching which interconnects those edges of those panels. The right-hand edge of the pocket lining 106 is attached to the left-hand edge of panel 26 and to the right-hand edge 22 of panel 18 by a row of stitching 118, of standard and usual design.

A similar pocket lining has the upper edge thereof stitched to the upper edge of the concave offset 42 of the panel 40 by stitches of standard and usual design. The lower portion of that pocket lining is secured to the lower edge 16 of the panel 10 by stitches of standard and usual design; and the right-hand edge of that pocket lining is secured to the lower portion of the right-hand edge of panel 10 and to the portion of the right-hand edge of panel 40, immediately below the concave offset 42, by stitching which secures those edges together. The left-hand edge of that pocket lining is secured to the left-hand edge 14 of the lower portion of panel 10 and the right-hand edge of the lower portion of the panel 26 by stitching which secures those edges together.

As indicated particularly by FIG. 4, the belt-like portion 90 consists of two layers. The left-hand edge of the bib-like portion 53 is secured to the right-hand edge of the belt-like portion 90 by a row of stitching 120, of standard and usual design. Thereafter, the left-hand edge of that bib-like portion and the right-hand edge of the belt-like portion 90 are secured together by a row of stitching 122, of standard and usual design. The belt-like portion 86 will be identical to the belt-like portion 90; and it will be stitched to the right-hand edge of the bib-like portion 53 in the same manner in which the belt-like portion 90 is stitched to the left-hand edge of that bib-like portion.

The yoke 32 has the lower edge thereof secured to the upper edge of panel 26 by stitches 108, of standard and usual design, as shown by FIGS. 2 and 7. Thereafter that lower edge is folded to have the configuration of FIGS. 2 and 7; and then is held folded by a row of stitches 110, of standard and usual design.

The facing 61 has the lower edge thereof secured to the lower edge of the U-shaped reinforcement 60 by a row of stitches 116, of standard and usual design. The upper edge of the horizontal portion of that U-shaped reinforcement is secured to the upper edge of the bib-like portion 53 by a row of stitches 112, of standard and usual design; and then that reinforcement and the facing 61 are secured to that bib-like portion by a row of stitches 114 of standard and usual design—all as shown by FIG. 2.

The panel 26 is made from a readily-expansible material so it can easily expand; and it extends from a level above the wearer's chest line to the level of the wearer's hip line. As a result, that panel can expand to accommodate the upper and middle front portions of heavily-built persons or can remain in an unstressed state to accommodate the upper and middle front portions of slightly-built persons. Many different kinds of readily-expansible material could be used in making the panel 26, but a ribbed, knit, stretch nylon has been found to be very useful. All of the rest of the panels of the uniform are made of less-expansible material.

As emphasized by FIG. 4, the bib-like portion 53 extends laterally outwardly beyond the sides of the readily-expansible panel 26; but it is not stitched to that panel. Similarly, the bib-like portion 53 is not stitched to the panel 10 or to the panel 18. The bib-like portion 53 is, of course, the upper part of the panel 40; and that panel is stitched to the lower portions of the outer edges of the panels 10 and 18. Also, the upper ends of the strap-like portions 46 and 54 of that bib-like portion are releasably securable to the front portions of the sleeves 36 and 38 by the buttons 62 and 64, respectively. However, as emphasized by FIGS. 4 and 6, the panels 10, 28 and 18 are not constrained or confined by the bib-like portion 53. As a result, the panel 26 is free to expand and contract to accommodate various sizes and configurations of the upper and middle front portions of wearers of the uniform. Also, the panels 10 and 18 are free to assume corresponding configurations without any restraint or confinement by the bib-like portion 53. Yet, that bib-like portion will overlie and conceal the panel 26; and hence will always be able to provide an attractive and relatively-unstressed appearance for the front upper half of the uniform.

It should also be noted that the belt-like portions 86 and 90 are stitched to the bib-like portion 53 and not to any of the panels 10, 18, 66 and 76. As a result, substantial portions of those panels are free to "fall" in natural-appearing folds or other draped forms in response to the sizes and configurations of the wearers.

The readily-expansible panel 26, and the freedom of that panel to expand and contract independently of the bib-like portion 53, enable one size of uniform to accommodate a wide range of sizes and configurations of the upper and middle front portions of wearers of that uniform. The buttons 94, 96, 98, 100, 102 and 104 and the belt-like portions 86 and 90 can coact with the freedom of substantial portions of the panels 10, 18, 66 and 76 to move relative to those belt-like portions to enable the uniform to accommodate wearers having many different waist sizes. Because those belt-like portions are stitched to the bib-like portion 53, and are not stitched to any of the panels 10, 18, 66 and 76, those belt-like portions permit substantial portions of those panels to "fall" in natural-appearing folds or other draped forms even where the wearers have small waists. The overall result is a uniform which is comfortable to wear, attractive in appearance, and capable of fitting persons of many sizes and configurations.

The inclined upper edge 12 of panel 10 is secured to the front portion of sleeve 36 by a row of stitching of standard and usual design; and, similarly, the inclined upper edge 20 of panel 18 is secured to the front portion of sleeve 38 by a row of stitching of standard and usual design. The upper portion of the left-hand edge 82 of panel 76 is secured to the other tape of zipper 132 by a row of stitching of standard and usual design. Hems of standard and usual design are provided for the ends of the sleeves 36 and 38, for the side edges 44 and 52 and the bottom edge 59 of the panel 40, for the bottom edges of panels 66 and 76, and for the edges of the U-shaped notch 58 at the top of the bib-like portion 53. Overcast or other stitching will be provided at the lower edges 16, 30 and 24, respectively, of the panels 10, 26 and 18.

The preferred embodiment of article of wearing apparel is the uniform shown and described by the drawing and accompanying description. However, the present invention is usable in other uniforms; and it also is usable in maternity dresses and further articles of wearing apparel other than uniforms. Consequently, although the drawing and accompanying description have shown and described one preferred embodiment of the present invention, it should be apparent to those skilled in the art that various changes may be made in the form of the invention without affecting the scope thereof.

What I claim is:

1. A plural-size, fitted article of wearing apparel which has a panel of readily-expansible material in the front thereof and which has a portion of less-expansible material overlying said panel of readily-expansible material, said panel of readily-expansible material extending downwardly from the chest area of said article of wearing apparel through the waist area of said article of wearing apparel to a point below said waist area, said panel of readily-expansible material having substantial portions thereof which are movable relative to said portion of less-expansible material and hence are capable of expanding and contracting in said chest and waist areas without corresponding expansion and contraction of said portion of less-expansible material in said chest and waist areas, said portion of less-expansible material substantially concealing said panel of readily-expansible material and providing a relatively unstressed fitted appearance for said front of said article of wearing apparel while permitting said panel of readily-expansible material to conform to the size and configuration of the wearer of said article of wearing apparel in said chest and waist areas, whereby said article of wearing apparel can be worn by persons having different sizes and configurations in said chest and waist areas of their front portions and yet can have a relatively unstressed fitted appearance.

2. A plural-size, fitted article of wearing apparel which has a panel of readily-expansible material in the front thereof and which has a portion of less-expansible material overlying said panel of readily-expansible material, said panel of readily-expansible material extending downwardly from the chest area of said article of wearing apparel through the waist area of said article of wearing apparel to the hip area of said article of wearing apparel, said panel of readily-expansible material having substantial portions thereof which are movable relative to said portion of less-expansible material and hence are capable of expanding and contracting in said chest, waist and hip areas without corresponding expansion and contraction of said portion of less-expansible material in said chest, waist and hip areas, said portion of less-expansible material substantially concealing said panel of readily-expansible material and providing a relatively unstressed fitted appearance for said front of said article of wearing apparel while permitting said panel of readily-expansible material to conform to the size and configuration of the wearer of said article of wearing apparel in said chest, waist and hip areas, whereby said article of wearing apparel can be worn by persons having different sizes and configurations in said chest, waist and hip areas of their front portions and yet can have a relatively un-stressed fitted appearance.

3. A plural-size, fitted article of wearing apparel as claimed in claim 1 wherein said panel of readily-expansible material is interposed between and is connected to panels of less-expansible material, wherein the upper end of said panel of readily-expansible material is located below the level of, and is free to move relative to, the upper end of said portion of less-expansible material, and wherein said portion of less-expansible material permits said panels of less-expansible material to move freely relative to it, whereby said portion of less-expansible material can have a relatively unstressed fitted appearance despite movement of said panel of readily-expansible material and of said panels of less-expansible material relative to it.

4. A plural-size, fitted article of wearing apparel as claimed in claim 1 wherein said panel of readily-expansible material is interposed between and is connected to panels of less-expansible material, and wherein said portion of less-expansible material overlies the inner edges of said panels of less-expansible material and extends above the upper edge of said panel of readily-expansible material.

5. A plural-size, fitted article of wearing apparel as claimed in claim 1 wherein said panel of readily-expansible material is free, throughout the entire length and width of its upper and side edges, to move relative to said portion of less-expansible material.

6. A plural-size, fitted article of wearing apparel as claimed in claim 1 wherein the upper end of said panel of readily-expansible material is spaced below the neckline of said article of wearing apparel, wherein said neckline is defined by a further portion of less-expansible material, and wherein the upper end of the first said portion of less-expansible material is free to move relative to said neckline.

7. A plural-size, fitted article of wearing apparel as claimed in claim 1 wherein belt-like portions extend outwardly from said portion of less-expansible material and are independent of said panel of readily-expansible material, whereby said panel of readily-expansible material is free to expand relative to said belt-like portions.

8. A plural-size fitted article of wearing apparel which has a panel of readily-expansible material in the front thereof and which has a portion of the front thereof which is made of less-expansible material overlying said panel of said readily-expansible material, said panel of readily-expansible material extending downwardly from the chest area of said article of wearing apparel through the waist area of said article of wearing apparel to a point below said waist area, said panel of said readily-expansible material having substantial portions thereof which are free to move relative to said portion of less-expansible material and hence are capable of expanding and contracting in said chest and waist areas, said panel of readily-expansible material having the side edges thereof secured to the side edges of adjacent portions of said article of wearing apparel which also are free to move relative to said less-expansible portion of said front of said article of wearing apparel, and belt-like portions which are secured to and which extend outwardly from said less-expansible portion of said front of said article of wearing apparel and which are independent of said panel of readily-expansible material and which can determine the effective waist size of said article of wearing apparel, said panel of said readily-expansible material and said adjacent portions of said article of wearing apparel being free to move relative to said less-expansible portion of said front of said article of wearing apparel and also relative to said belt-like portions, whereby said panel of said readily-expansible material and said adjacent portions of said article of wearing apparel and said belt-like portions can enable said article of wearing apparel to provide a neat and attractive appearance when said article of wearing apparel is worn by a thin wearer who is slightly-built in said chest and waist areas and also to provide a neat and attractive fitted appearance when said article of wearing apparel is worn by a wearer who is larger in said chest and waist areas.

9. A plural-size, fitted article of wearing apparel as claimed in claim 8 wherein said belt-like portions extend around the sides of said article of wearing apparel and are securable in the rear of said article of wearing apparel to coact with said panel of said readily-expansible material to establish a desired waist size for said article of wearing apparel.

10. A plural-size, fitted article of wearing apparel as claimed in claim 8 wherein said belt-like portions extend around the sides of said article of wearing apparel and are securable to a portion of the rear of said article of wearing apparel by a plurality of spaced-apart fasteners which coact with said belt-like portions and with said panel of said readily-expansible material to establish a desired waist size for said article of wearing apparel, said belt-like portions and said plurality of spaced-apart fasteners and said panel of readily-expansible material enabling said article of wearing apparel to accommodate wearers with different waist measurements.

11. A plural size, fitted article of wearing apparel which has a first portion of the front thereof overlain by a further portion of the front thereof, said first portion of said front of said article of wearing apparel being made of readily-expansible material and having the upper and side edges thereof independent of said further portion of said front of said article of wearing apparel so said upper and side edges are free to move relative to said further portion of said front of said article of wearing apparel, said readily-expansible first portion of said front of said article of wearing apparel extending downwardly from the chest area of said article of wearing apparel through the waist area of said article of wearing apparel to the hip area of said article of wearing apparel and having substantial portions thereof which are movable relative to said further portion of said front of said article of wearing apparel and hence are capable of expanding and contracting in said chest, waist and hip areas without corresponding expansion and contraction of said further portion of said front of said article of wearing apparel, and belt-like portions which are secured to and which extend outwardly from said further portion of said front of said article of wearing apparel, said readily-expansible first portion of said front of said article of wearing apparel being free to move relative to said belt-like portions which are secured to said further portion of said front of said article of wearing apparel, whereby said readily-expansible first portion of said front of said article of wearing apparel can enable said article of wearing apparel to provide a neat and attractive fitted appearance when said article of wearing apparel is worn by a wearer who is thin and slightly-built in said chest, waist and hip areas and also to provide a neat and attractive fitted appearance when said article of wearing apparel is worn by a wearer who is larger.

* * * * *